US008752778B2

(12) United States Patent
Brown

(10) Patent No.: US 8,752,778 B2
(45) Date of Patent: Jun. 17, 2014

(54) MILL AND METHOD OF MILLING

(75) Inventor: Christopher John Brown, Glossop (GB)

(73) Assignee: Maelstrom Advanced Process Technologies Limited, Glossop (GB)

( * ) Notice: Subject to any disclaimer, the term of this patent is extended or adjusted under 35 U.S.C. 154(b) by 211 days.

(21) Appl. No.: 13/511,872

(22) PCT Filed: Jan. 25, 2011

(86) PCT No.: PCT/GB2011/000094
§ 371 (c)(1),
(2), (4) Date: May 24, 2012

(87) PCT Pub. No.: WO2011/064606
PCT Pub. Date: Jun. 3, 2011

(65) Prior Publication Data
US 2013/0020419 A1 Jan. 24, 2013

(51) Int. Cl.
*B02C 11/08* (2006.01)
*B02C 15/00* (2006.01)
*B02C 1/08* (2006.01)

(52) U.S. Cl.
USPC ..... 241/23; 241/228; 241/252

(58) Field of Classification Search
USPC ..... 241/23, 65, 252, 228
See application file for complete search history.

(56) References Cited

U.S. PATENT DOCUMENTS 1,184,841 A * 5/1916 Fasting ..... 241/157
1,184,842 A * 5/1916 Fasting ..... 241/252
1,428,687 A * 9/1922 Ferencz ..... 241/163
1,521,795 A * 1/1925 Smith et al. ..... 241/252
1,605,007 A * 11/1926 Smith et al. ..... 241/247
1,663,355 A * 3/1928 Smith et al. ..... 241/252
2,105,003 A * 1/1938 Morch ..... 241/252
2,361,121 A 10/1944 Poupin
4,199,113 A * 4/1980 Genev ..... 241/167
7,108,207 B2 9/2006 Waznys et al.
2001/0028006 A1 10/2001 Schmitt

FOREIGN PATENT DOCUMENTS

EP 0126437 A2 11/1984

OTHER PUBLICATIONS

UKIPO Search Report for Application No. GB0920603.8 dated Jan. 6, 2011.
International Search Report for Application No. PCT/GB2011/000094 dated Jul. 19, 2011.
Written Opinion for Application No. PCT/GB2011/000094 dated Jul. 19, 2011.

* cited by examiner

*Primary Examiner* — Faye Francis
(74) *Attorney, Agent, or Firm* — Linda B. Huber; Nixon Peabody LLP

(57) ABSTRACT

A milling apparatus in which at least two independently driven axiaily mounted elements are eccentrically mounted one within the other so as to define a processing chamber (12) therebetween with the minimum radial gap between the elements at one position being diametrically opposite to the maximum radial gap. Stresses are applied to the material by passing it through the minimum radial gap, which is adjustable. The elements may be rotated in the same direction to apply compressive and extensional stresses to material within the minimum gap, or in opposite directions to apply shear stresses to the material within this gap. A third element may be incorporated within the chamber to provide heat transfer and distributive mixing to the stressed material.

24 Claims, 5 Drawing Sheets

27
28

29
30

31
32
X
X
Y
Y

MILL AND METHOD OF MILLING

The present invention relates to milling and provides a new milling apparatus and milling method. In particular, the present invention relates to high energy milling of small particles of material within a fluid medium. It will be understood that the term "milling" includes the processing of single materials, and that the term "hard" material has the meanings of "hardness" and or "strength".

The operation of milling is generally understood to comprise the comminution of discrete parts or particles of material by means of a grinding action against a surface or between surfaces. In such a process the material parts are reduced in size as a result of one or more of the compressive, tensile and shear stresses applied to them. Examples of milling apparata providing such an effect include: disc mills, in which the material is typically subjected to crushing and shearing actions between flat surfaces; rolling mills, in which the material is typically subjected to crushing and shearing actions between curved surfaces; stamping mills, in which the material is typically subjected to compressive loading between surfaces; ball or bead mills, in which the material is typically subjected to crushing and shearing actions between surfaces; and jet impact mills, in which the material is typically subjected to compressive loading through impingement against surfaces or other jets of material.

An alternative approach to using solid surfaces that are brought into direct contact with the surfaces of the material being milled is to use fluid material as a matrix to surround and be in full surface contact with the individual parts of the material being milled, then by acting directly on the fluid, to indirectly apply stress to the material parts. Examples of milling apparata providing such an effect include: saw tooth mills, in which the fluid matrix is subjected to shear stresses through the action of rotating discs, with such stresses then being transmitted to the particles through the fluid/material interface; and homogenisers, in which the fluid matrix is subjected to one or more of shear, extensional and impact stresses, with such stresses then being transmitted to the particles through the fluid/material interface.

It will be understood that many types of useful milling apparata have been invented and developed over the centuries, each with its own advantages and disadvantages.

At present, it is generally accepted that the bead mill provides the best available means for processing relatively hard sub-micron particles. Such mills are well known in the literature. However, limitations of the bead mill process include: the inherent randomness of the process that arises from the uncontrolled interactions between the beads and the particulates and that requires lengthy processing times in order to assure that all particles have been reduced to size desired; the damage to the beads themselves that arises from their high local impact loads on the material and on one another, with the fragments of the beads contaminating the material being processed; the surface roughness of the beads which firstly reduces the contact area available to interact with the milled material, and secondly results in small milled particles becoming trapped within the structure of the bead and thus insulated from further comminution activity.

The alternative fluid matrix type of mills, described above, are also ineffectual when milling relatively strong particles at very small sizes. This is primarily a function of the processing length scales, where at the larger gaps required to accommodated the initial particles, the fluid stresses are insufficient to achieve breakdown of hard materials.

Both the bead mill and the fluid matrix types of milling apparata suffer two further major limitations when processing finely divided material. The first limitation is that the very high energy densities required to break hard particles at the sub-micron scale impart proportionately high temperatures to the material; such temperature rises risk damage to the material properties. The second limitation is that they are inherently incapable of preventing immediate recombining of the particulates; such recombination tendencies increase as the size of the particle reduces, while the timescale within which this occurs also reduces.

It may therefore be appreciated that the mechanical size reduction of very small particulates, especially in the sub-micron size range, presents significant challenges that are not adequately addressed by any known type of milling apparatus. This is especially problematic when attempting to process material quantities at industrial scales. It is an object of the present invention to provide a mill and method that can achieve such size reduction at industrially relevant production rates.

According to a first aspect of the present invention there is provided a milling apparatus for milling material, the apparatus comprising at least two axially extended members eccentrically mounted one within the other so as to define a chamber therebetween; the interior surface of the outer member being centred on the axis of that outer member; the exterior surface of the inner member being centred on the axis of that inner member; both first and second members being rotatable about their respective axes; an inlet for introducing material to be milled into the mixing chamber, and an outlet for removing milled material from the mixing chamber; for any given axial position the variation in radial distance between the two members defining a gap that alternately decreases and increases with respect to circumferential movement, for the purpose of applying movement and stress to material entering the gap; wherein the material passing through the chamber describes a substantially spiral path with respect to the axial orientation of the inner and outer members; and wherein the material within the chamber is subjected primarily to mechanically induced compressive stresses and fluid induced extensional stresses when both first and second members rotate in the same direction, and primarily to fluid induced shear stresses when both first and second members rotate in opposite directions.

According to a second aspect of the present invention there is provided a member that extends axially into the chamber for the purposes of extracting the heat arising from the application of stress to the material immediately on exiting from the highly stressed zone.

According to a third aspect of the present invention there is provided a member that extends axially into the chamber for the purposes of preventing the immediate recombination of ruptured particles by disrupting and separating the flow patterns of the material immediately on exiting from the highly stressed zone.

Specific embodiments of the present invention will now be described, by way of examples only, with reference to the accompanying drawings in which.

Figures 4A, 4B, 4C:
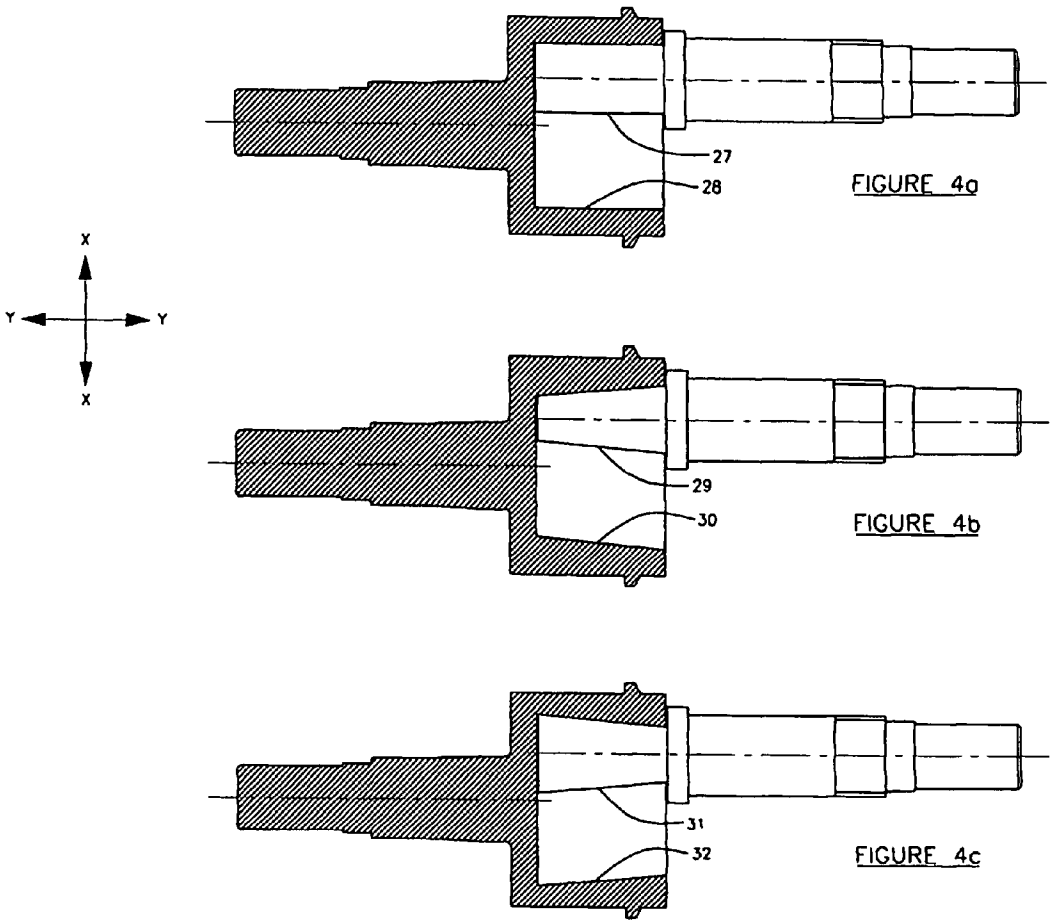
Figure 5:
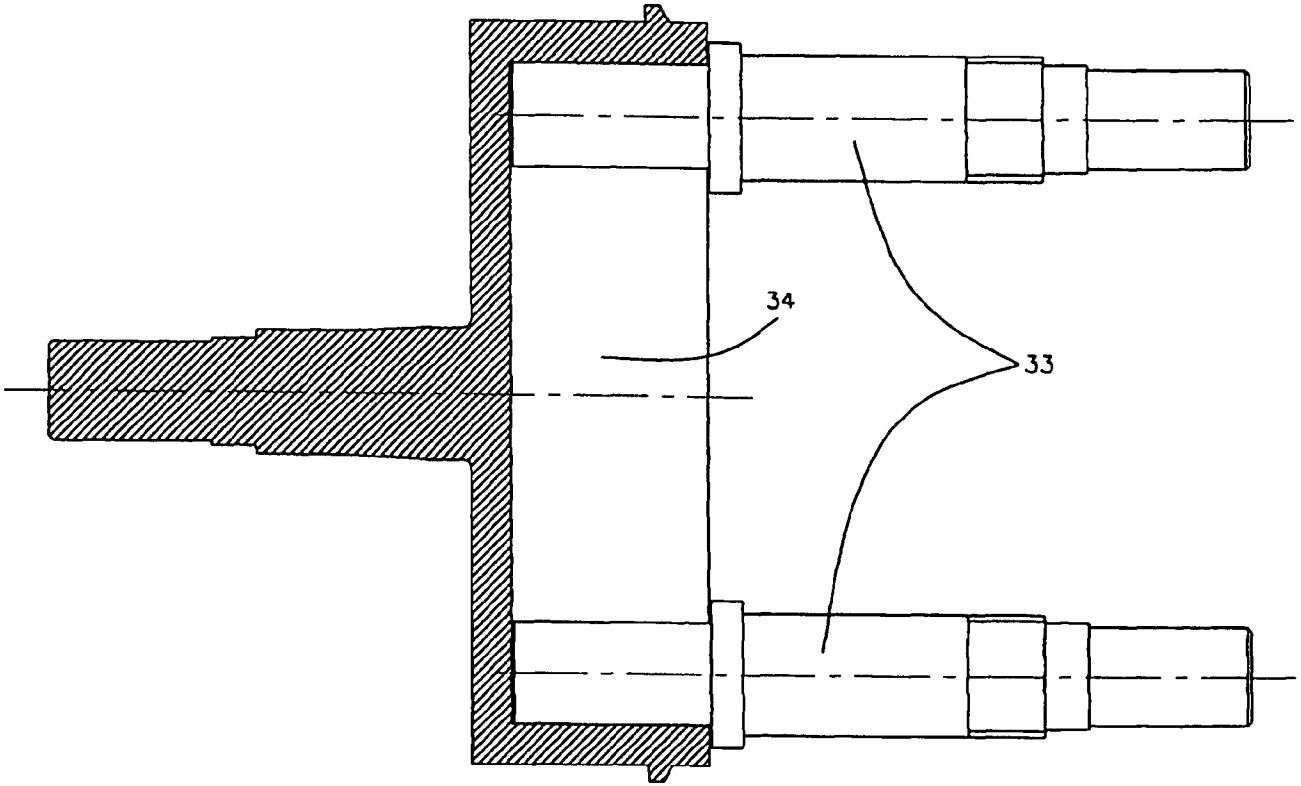

FIGS. 4*a*, 4*b*, 4*c* are part-sectioned plan views providing illustrations of various alternative rotor shapes in accordance with the present invention;

FIG. 5 is a part-sectioned plan view providing an illustration of a further embodiment of the present invention in which multiple rotors are incorporated.

Figure 1:
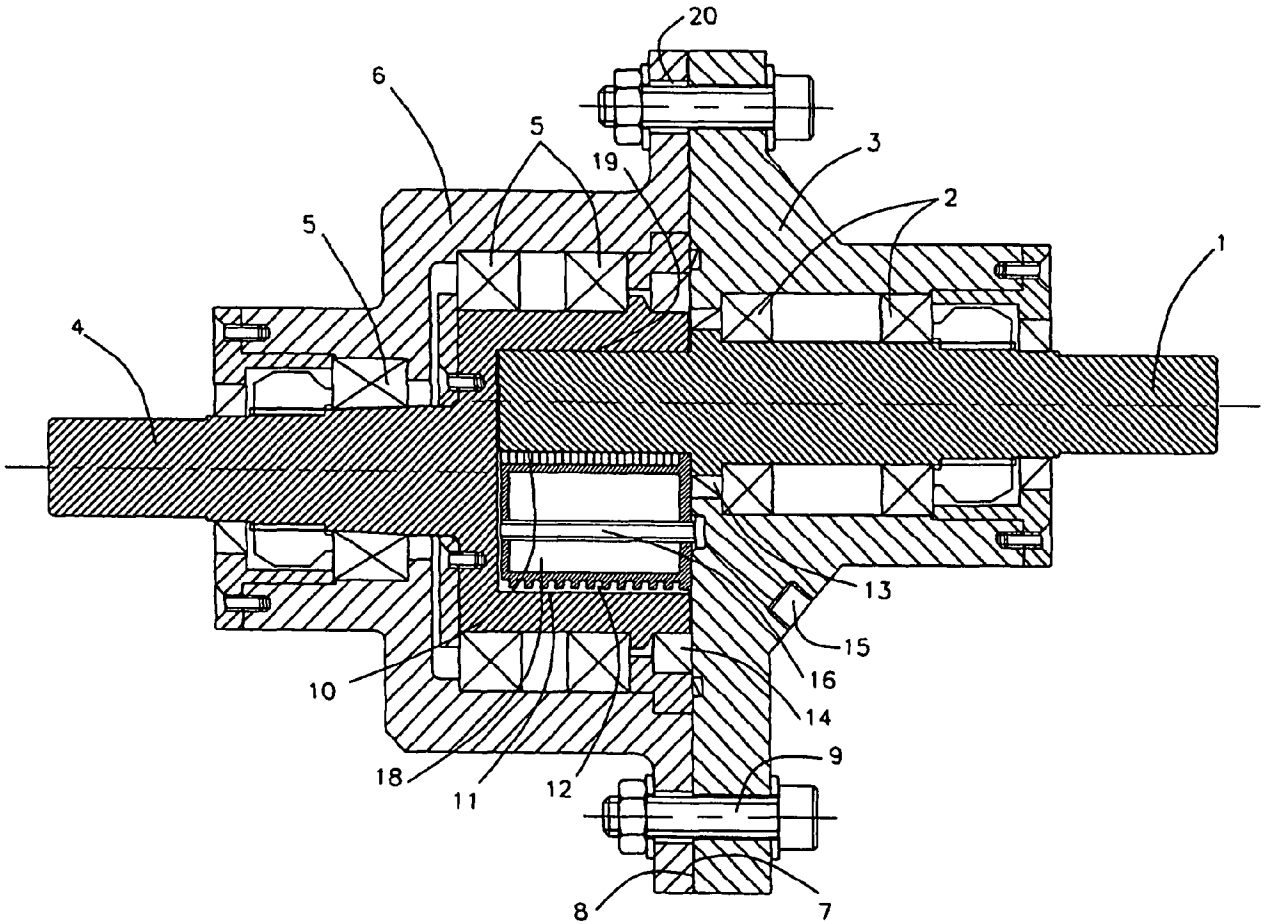
FIG. 1 is an axial plan view section through a first embodiment of the present invention.

Referring to FIG. 1, the illustrated mill comprises a first rotor 1 supported in bearings 2 within a stator housing 3, and a second rotor 4 supported in bearings 5 within a stator housing 6. The axes of first rotor 1 and second rotor 4 are parallel to one another and perpendicular to faces 7 and 8 of their respective stator housings 3 and 6. Stator housings 3 and 6 are connected together through their respective faces 7 and 8 by means of fasteners 9, such that the exterior end surface 10 of rotor 1 lies inside the interior surface 11 of rotor 4 and a processing chamber 12 is formed between these surfaces and surface 7 of stator 3. The chamber is finally enclosed by means of seals 13 and 14 that seal the interfaces between rotor 1 and stator housing 3, and rotor 4 and stator housing 6, respectively.

Processing material is pumped into passage 15 by external means (not shown), thereafter entering the processing chamber 12 through passage 16 and discharging into the far end of the chamber. Processing material exits the processing chamber through passage 17 (FIG. 2) that passes through the wall of stator 3 in the same manner as passage 15.

A heat exchanger baffle 18 is located within the processing chamber 12, attached to wall 7 of stator housing 3.

Figure 2:
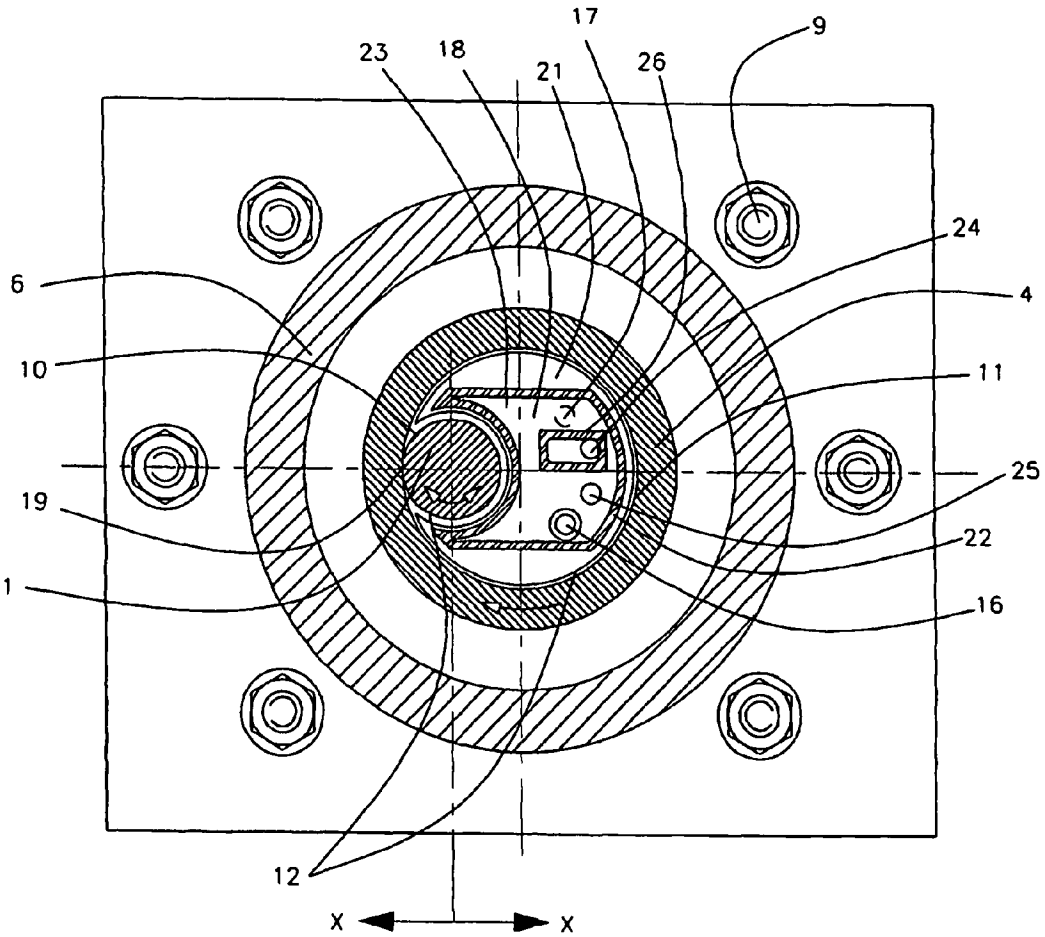
FIG. 2 is a sectional end view of the embodiment of FIG. 1.

Referring to FIG. 2, it will be appreciated that the radial gap 19 between faces 10 and 11 of the rotors can be adjusted by moving the assembly of stator housing 3 along the direction of the XX axis relative to the assembly of stator housing 6, thereafter fixing the position of the two by means of fasteners 9. Sufficient clearances 20 (FIG. 1) are provided in stator housing 6 to accommodate such movement.

Both rotor 1 and rotor 4 can be independently driven in either direction by means of rotary actuators (not shown). In a preferred embodiment of the invention, the driven direction of rotation of rotor 1 is capable of being selected from both directions, while the driven direction of rotation of rotor 4 is not selectable. It may be noted that either one of the rotors may not be driven at all, either being prevented from rotation by means, for example, of a brake, or being permitted to rotate freely; this option is not further described in this preferred embodiment.

The rotary motion of face 11 of rotor 4 exerts a drag force in the tangential direction on process material contained within the chamber 12. This drag force imparts a rotation to the process material with consequent radial centrifugal forces on the face 11. Process material entering the chamber 12 through passage 16 is thereby significantly directed and propelled into and through the gap 19 before being ejected back into the chamber. This circulatory flow imposes a spiral flow pattern on all material as it passes axially from one end of the chamber to the other and is then discharged through passage 17.

When both rotors are rotating in the same direction (co-rotating), gap 19 is formed between surfaces travelling in the same direction. Material entering this gap is therefore subjected to high drag forces that are substantially aligned. This action has the effect of subjecting the entrained material to high extensional stresses, whereby each element of material is significantly extended in length in the direction of its flow. It will be appreciated that such extensional stresses are very effective in rupturing materials under essentially tensile stress conditions. It will further be appreciated that the co-directional movement of the converging surfaces imparts a direct mechanical compressive stress to the materials in the direction normal to their flow and to the extensional stresses, with the consequence that single particulates or agglomerations of particulates are mechanically crushed between the surfaces. Because the velocity of the entrained fluid entering the gap is similar to that of the surfaces, the shear stresses imparted directly to the material are relatively low under these circumstances.

When the rotors are rotating in the opposite directions (contra-rotating), gap 19 is formed between surfaces travelling in opposite directions. As the shear stresses in this gap zone are directly proportional to the relative velocities of the two surfaces and inversely proportional to their separation distance, significant shear stresses are imposed on material passing through the gap. These shear stresses are very effective in rupturing materials under essentially shearing conditions, where shear stresses applied through a fluid medium are transferred to the surfaces of the particulates to be ruptured. It will be appreciated that the contra-directional movement of the converging surfaces mitigates against large particulates or agglomerates easily entering into the gap zone, thereby rendering this type of rotation more suited to particulates that are relative small in comparison to the radial gap length.

It will be appreciated that in both co-rotation and contra-rotation, the stresses imparted on materials in gap 19 increase at decreasing gap settings along the XX axis, and decrease at increasing gap settings. It will further be appreciated that the stresses increase in proportion to the speeds of the various surfaces, and to the viscosity of the process material being stressed.

Under both conditions of rotation, material exiting the gap 19 enters an expanding zone of chamber 12 in which the centrifugal effects imparted by rotor 4 tend to force material towards surface 11 and hence encourage a generally circulatory flow within the chamber. It will be appreciated however that it is beneficial to impose a vigorously agitated flow-field immediately following the stressing in gap 19, in order to promote, through a distributive mixing action, the ongoing physical separation of the ruptured particles while they stabilise and thereby the prevention of their immediate reagglomeration. When operating in contra-rotating mode, the fluid movements in the exit zone are especially vigorous given the local circulatory flows induced by the drag forces imparted by the oppositely moving surfaces: such vigorous movements, which can be expected to include turbulence, are very effective at preventing reagglomeration. When operating in co-rotating mode, the flows in this area are dominated by streamlines aligned with the surfaces and are relatively less vigorous.

Figure 3:
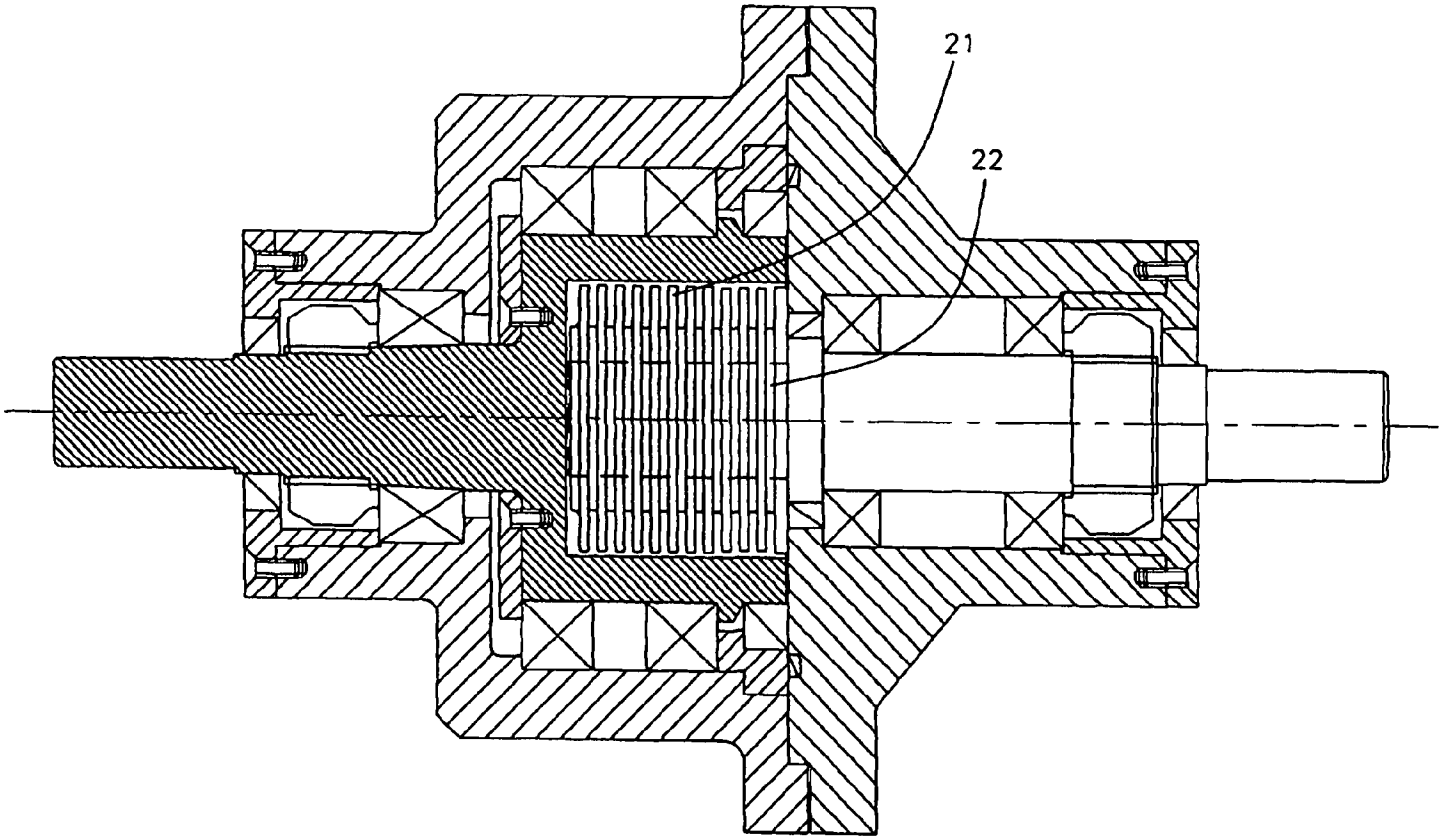
FIG. 3 is a part-sectioned side view of the embodiment of FIG. 1.

Referring to FIGS. 1, 2 and 3, the illustrated mill contains a combined heat exchanger and baffle 18, located within the processing chamber 12. It will be appreciated that FIG. 3 depicts this baffle un-sectioned. The baffle comprises a number of parallel planar finned projections 21 that extend towards but do not make contact with rotating surfaces 10 and 11. These finned projections extend from external walls 22 enclosing a hollow chamber 23. Cooling fluid, such as water, is pumped into chamber 23 by means of an external actuator (not shown) through passage 25 in stator housing wall 7. The cooling fluid then passes down the length of the chamber 23 and exits it through internal passage 26 and thence passage 24 in stator housing wall 7. It will be appreciated that while this forms a contra-flow heat exchanger configuration, a co-flow heat exchanger configuration can be applied by reversing the direction of cooling fluid flow.

It will be appreciated that apparatus in accordance with the present invention can be equipped with additional heat transfer capability, for example by configuring the rotors and/or the stators with cooling channels capable of transferring heat from or to the surfaces of the chamber 12.

In addition to providing heat exchange in the immediate vicinity of the exit from the highly stressed gap zone 19, the baffle projections 21 act to disrupt the circulatory flow patterns within chamber 12, as well as to impede flow down the chamber in the axial direction. This last action ensures that all material within the chamber periodically passes though the gap 19 rather than circumventing it during its residence within the chamber.

FIGS. 1, 2 and 3 depict a preferred embodiment of the invention, as described above.

Referring to FIGS. 4*a*, 4*b* and 4*c*, the illustrations show various alternative configurations of the rotor surfaces. In FIG. 4*a* the rotor surfaces 27 and 28 are parallel with one another and with the axes of both rotors. In FIG. 4*b* the rotor surfaces 29 and 30 are parallel with one another, but surface 29 converges towards its end while surface 30 diverges towards its end. In FIG. 4*c* the rotor surfaces 31 and 32 are parallel with one another, but surface 31 diverges towards its end while surface 32 converges towards its end.

The configuration shown in FIG. 4*a* permits the radial gap between rotor surfaces to be adjusted by means of relative movement along axis XX. The configurations shown in FIGS. 4*b* and 4*c* permit the radial gap between rotor surfaces to be adjusted by means of relative movement along axis YY in addition to or instead of that along axis XX. The relatively small taper angles embodied in FIGS. 4*b* and 4*c* are advantageous in that they permit small radial gap adjustments to be achieved with relatively large axial movements, thereby increasing accuracy.

It will be appreciated that the application of tapered surfaces, as shown in FIGS. 4*b* and 4*c*, affects the axial flow patterns within the chamber. The surfaces shown in FIG. 4*b* promote a net axial flow outwards of the larger rotor, while the surfaces shown in FIG. 4*c* promote a net axial flow inwards. Such effects can be selected at the design stage in order to achieve specific processing objectives.

Referring to FIG. 5, the illustration shows multiple inner rotors 33 in combination with outer rotor 34. Advantages of such a configuration include the possibility of balancing the radial forces being applied to outer rotor 34.

It will be appreciated that while the Figures have depicted horizontal configurations, the apparatus according to the present invention can be mounted in any orientation. For example, batch mixing may be facilitated in some circumstances by mounting the apparatus vertically with the larger rotor constituting a vessel in which the material is contained.

It will be appreciated that the larger rotor may be configured with a hollow element that is separable from the remainder of the drive shaft, thereby providing a vessel that is relatively easily detached. It will also be appreciated that the rotors 1 and 4 may be configured with detachable sleeves containing surfaces 10 and 11 respectively.

Apparatus according to the present invention can be operated in batch or in continuous mode.

In a preferred method of operation in batch mode, material would initially be subjected to milling by the rotors being driven co-rotationally at a radial gap that was commensurate with the larger particle sizes. This would apply high compressive and/or crushing forces as well as high elongational stresses to the larger particles in order to rapidly rupture them to a relatively homogeneous smaller size. The radial gap between rotors could be reduced in a series of steps during this stage, according to the degree of comminution desired. With the particulates finely divided, the gap could be set to a size that would not result in any material becoming wedged and the rotors then driven contra-rotationally. This would apply high shear to the material in the gap, thereby reducing the particles to smaller sizes. The radial gap between rotors could again be reduced in a series of steps during this stage, according to the degree of comminution desired, until the material is ready for discharge. The duration of each step of mixing would be largely dictated by the need to ensure that all material contained within the batch had been passed though the gap. The duration of the entire process could be increased or decreased according to the number of incremental changes to the gap required. It will be appreciated that the entire process could be accomplished on a single apparatus without the need to transfer material between apparata.

In a preferred method of operation in continuous mode, the material to be processed would be pumped through the apparatus by some external means such as a pump. With a constant radial gap between rotors being maintained, material passing though the milling chamber would be subjected to a minimum of one pass through the high stress radial gap. It will be appreciated that the number of passes through the gap that any one particle would experience during its transition through the chamber would be a function of variables such as speeds, gap and chamber sizes, lengths and pumping rates. The processing steps would proceed along the same tines and that described above for batch mixing, with contra-rotating operations preceding co-rotating operations. The material could be passed through a series of mills, with each mill being configured with the desired gaps and rotational direction and speed. Alternatively, the material could be recirculated through a single apparatus, either continuously with the gap, speed and direction settings being adjusted periodically, or semi-continuously with the material being passed from and to storage vessels and the gap, speed and direction settings being adjusted between passes. In the case of the single apparatus, it will be appreciated that the entire process could be accomplished on a single apparatus without the loss of materials within numerous milling apparata and with a minimised risk of contamination. In the case of the multiple mill configuration, it will be appreciated that the multi-functional capability of the apparatus enhances the flexibility and economy of configuring and operating relatively short production runs.

It should be noted that the level of mechanical energy input into the material being milled must be substantially matched with the level of heat energy extracted from the material, if the process is to remain stable. Failure to do so will result in undesirable consequences such a as thermal degradation of the equipment and/or the materials, or clashing damage between surfaces resulting from local thermal expansions. The effectiveness of the heat exchange is therefore critical to the process. This is a function of surface engineering, whereby the surface areas and configurations are optimised for convective heat transfer, and positioning, whereby the heat exchanging surfaces are located within the critical areas of the chamber, especially the exit zone from the gap.

It will be appreciated that milling devices in accordance with the present invention can be combined with auxiliary equipment, for example pumps, vessels, heat exchangers and analytic instrumentation. It will further be appreciated that the processes can be automated, for example by automatically adjusting processing conditions such as gaps, speeds and directions: either in response to open-loop control methods such as imposed sequencing control, or closed-loop control methods based on sensed process conditions.

The apparatus and methods in accordance with the present invention offer many advantages over the present state of the art. The ability to operate as either a co-rotating or contra-rotating device, with the two different stressing mechanisms that this provides to both batch and continuous operations, provides operational advantages as described above. The action of contra-rotation ensures that, in order to achieve a given shear rate, the rotational velocity of each of the individual rotors is significantly lower than it would be with a single rotor device: this has major advantages in reducing the speed requirements on drives, bearings, seals, etc. The action of independent drives, both in co-rotation and contra-rotation, provides significant flexibility in adjusting the friction ratios between the milling surfaces of the rotors, in addition to optimising the stress fields created: this is of major benefit in maximising the effectiveness of the stress fields in the high stress gap zone. The ability to vary the flowrate, under continuous processing conditions, enables the stress/strain history to be optimised while controlling the heat transfer from the material, by regulating the number of passes of material through the high stress gap during its transition through the chamber. The ability to disrupt the flow fields in the immediate post-stressing zone prevents immediate reagglomeration of the fragmented particulates by ensuring their mutual separation while they stabilise within the fluid medium. The ability of the baffle arrangement to prevent direct axial flows through the chamber ensures that the material is subjected to a uniform shear/strain history and therefore achieves homogeneity within the minimum time. The ability to provide cooling to all surfaces ensures that the maximum levels of mechanical energy can be applied during the milling process. The arrangement of the one rotor within the other ensures that any localised thermal expansion arising from the high mechanical energies serves to expand the larger rotor surface away from that of the smaller rotor surface, thereby avoiding damaging mechanical clashing and interference. The ability to adjust the free volume of the processing chamber by interchanging baffle heat exchangers of differing displaced volumes enables the processing characteristics of a single item of milling apparatus in accordance with the present invention to be significantly changed. It will be appreciated that the above list of advantages is not exhaustive and is provided by way of example.

The invention has application across all industries where milling is required. Examples of industries in which the apparatus of the current invention can be applied are fine chemicals, petro chemicals, agro chemicals, foods, drinks, pharmaceuticals, healthcare products, personal care products, industrial and domestic care products, packaging, printing, paints, polymers, water and waste treatment.

The invention claimed is:

1. A milling apparatus for milling material, the apparatus comprising:

at least two axially extended members eccentrically mounted one within the other so as to define a chamber therebetween;

the interior surface of the outer member being centred on the axis of that outer member;

the exterior surface of the inner member being centred on the axis of that inner member;

both inner and outer members being rotatable about their respective axes;

an inlet for introducing material to be milled into the mixing chamber, and an outlet for removing milled material from the mixing chamber;

whereby, for any given axial position, the variation in radial distance between the two members defines a gap that alternately decreases and increases with respect to circumferential movement, for the purpose of applying movement and stress to material entering the gap, such that material passing through the chamber is caused to describe a substantially spiral path with respect to the axial orientation of the inner and outer members;

and further such that material within the chamber is subjected primarily to mechanically-induced compressive stresses and fluid-induced extensional stresses when both inner and outer members rotate in the same direction, and primarily to fluid-induced shear stresses when both inner and outer members rotate in opposite directions;

characterized in that a third member extends axially into the chamber for the purpose of extracting the heat arising from the application of stress to the material immediately on exiting from the highly stressed zone.

2. A milling apparatus according to claim 1, wherein the surfaces of the inner and outer members are defined as parallel-sided cylinders, whereby the distance defining the high stress gap between the surfaces may be adjusted by displacing at least one of the inner or outer members perpendicular to its axis.

3. A milling apparatus according to claim 1, wherein the surfaces of the inner and outer members are defined as cones, whereby the distance defining the high stress gap between the surfaces may be adjusted by displacing at least one of the inner or outer members along its axis.

4. A milling apparatus according to claim 1, wherein the inner and outer members are rotated independently of one another.

5. A milling apparatus according to claim 1, wherein the exterior surface of the third member is arranged to induce flow instability into the material immediately on exiting from the highly stressed zone, for the purpose of inhibiting particle recombination.

6. A milling apparatus according to claim 1, wherein the exterior surface of the third member is arranged so as to inhibit the axial flow of material within the chamber, for the purpose of ensuring that each part of the material removed from the chamber has been subjected to substantially the same stress and strain history as any other part.

7. A milling apparatus according to claim 1, further comprising a means of localised heat extraction to control thermal expansion arising from local stresses to ensure that the surfaces do not close one upon the other.

8. A milling apparatus according to claim 1, wherein the number of inner members exceeds one.

9. A milling apparatus according to claim 1, wherein the surface of the inner or the outer member in contact with the process material is contained within a sleeve that is detachable from the remainder of said member.

10. A milling apparatus according to claim 9, wherein the surface of the outer member in contact with the process material is contained within a part that is detachable from the remainder of the outer member to form a vessel.

11. A method of milling, comprising providing a milling apparatus as claimed in claim 1 operable such that material passing through the chamber describes a substantially spiral path with respect to the axial orientation of the inner and outer members;

and such that material within the chamber is subjected primarily to mechanically-induced compressive stresses and fluid-induced extensional stresses when both inner and outer members rotate in the same direction, and primarily to fluid-induced shear stresses when both inner and outer members rotate in opposite directions.

12. A method according to claim 11, wherein when both inner and outer members rotate in the same direction, the same surface speed is applied to both surfaces to ensure a substantially crushing and extensional action.

13. A method according to claim 11, wherein when both inner and outer members rotate in the same direction, different surface speeds are applied to both surfaces to ensure a reduced crushing and extensional action and an enhanced shearing action.

14. A method according to claim 11, wherein when both inner and outer members rotate in opposite directions, high relative velocities are applied from the sum of the two individual velocities to ensure a substantially shearing action.

15. A method according to claim 11, wherein the minimum gap between inner and outer members is varied in order to achieve variations in the stress and strain history of the material processed.

16. A method according to claim 11, wherein the relative rotational speeds and or directions of inner and or outer members is varied to achieve variations in the stress and strain history of the material processed.

17. A method according to claim 11, wherein the flowrate is varied to achieve variations in stress and strain history of the material processed.

18. A method according to claim 11, wherein the temperature is varied to achieve variations in stress and strain history of the material processed.

19. A method according to claim 11, wherein the volume and or flow and or heat transfer characteristics of the processing chamber are changed by means of removing one configuration of the third member and replacing it with an alternatively configured third member.

20. A method according to claim 11, wherein the apparatus is applied to the purpose of batch milling.

21. A method according to claim 11, wherein the apparatus is applied to the purpose of continuous milling.

22. A method according to claim 11, wherein a single apparatus is operated over multiple periods sequentially configured in one or more modes of rotation and with one or more settings of the processing variables.

23. A method according to claim 11, wherein a single apparatus is operated with multiple passes through it that are sequentially configured in one or more modes of rotation and with one or more settings of the processing variables.

24. A method according to claim 11, wherein multiple apparata are operated with a single pass them concurrently and in which each apparatus is configured in one or more modes and with one or more settings of the processing variables.

* * * * *